US007458845B2

(12) United States Patent
Sumitani et al.

(10) Patent No.: US 7,458,845 B2
(45) Date of Patent: Dec. 2, 2008

(54) TERMINAL ASSEMBLY FOR SELECTIVELY COUPLING LOADS IN PARALLEL AND IN SERIES

(75) Inventors: Yoichiro Sumitani, Rancho Palos Verdes, CA (US); Lin Chun-Yi, Xinzhuang (TW)

(73) Assignee: Sound Sources Technolog, Inc, Torrance, CA (US)

( * ) Notice: Subject to any disclaimer, the term of this patent is extended or adjusted under 35 U.S.C. 154(b) by 0 days.

(21) Appl. No.: 11/453,647

(22) Filed: Jun. 15, 2006

(65) Prior Publication Data

US 2007/0293082 A1 Dec. 20, 2007

(51) Int. Cl.
*H01R 31/08* (2006.01)

(52) U.S. Cl. ..... 439/507

(58) Field of Classification Search ..... 439/507, 439/502, 522, 500–501, 797, 709, 722, 952; 320/105, 66, 112; 381/332
See application file for complete search history.

(56) References Cited

U.S. PATENT DOCUMENTS 2,992,401 A 7/1961 Lewis
5,367,243 A * 11/1994 Wells et al. ..... 320/105
6,215,273 B1 * 4/2001 Shy ..... 320/105
6,222,342 B1 * 4/2001 Eggert et al. ..... 320/105
6,244,904 B1 6/2001 Fabian et al.
6,325,675 B1 12/2001 Harmeyer
6,656,000 B2 12/2003 Abdo
6,782,111 B1 8/2004 Wagner, II et al.
6,997,759 B1 2/2006 Zahnen et al.

* cited by examiner

*Primary Examiner*—Edwin A. León
(74) *Attorney, Agent, or Firm*—Stetina Brunda Garred & Brucker

(57) ABSTRACT

A terminal assembly that selectively couples multiple electrical loads in parallel or in series includes a circuit board that may be defined by a first section and a second section. A housing is disposed on the circuit board, and defines an access aperture overlapping multiple sets of jumpers attached to the first and second sections of the circuit board A cover is positioned on the access aperture to selectively expose the set of jumpers of the first section of the circuit board and the set of jumpers of the second section of the circuit board.

6 Claims, 9 Drawing Sheets

TERMINAL ASSEMBLY FOR SELECTIVELY COUPLING LOADS IN PARALLEL AND IN SERIES

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Technical Field

The present invention generally relates to electrical terminal assemblies. More particularly, the present invention relates to audio signal terminals for connections to loudspeakers.

2. Related Art

While significant improvements have been made in the development of high power loudspeakers, alternative solutions that utilize existing loudspeakers have been considered because of increased costs associated with such improved loudspeakers. These alternative solutions have involved the connecting of the loudspeakers in series or in parallel for enhanced performance. The loudspeakers are connected to an audio signal source, which may be a stereo receiver, an amplifier, etc. As is generally understood, a series connection of multiple loudspeakers increases the load impedance, resulting in a more efficient operation of the audio signal source. However, with the increase in load impedance, there is a decrease in the voltage applied to each loudspeaker and a consequential decrease in the audio output of the same. On the other hand, parallel connections decrease the load impedance, and while each loudspeaker is applied a constant voltage level, current draw on the audio signal source increases.

In addition to individual loudspeakers having single voice coils, recent advances in loudspeakers, particularly in woofers and subwoofers, have introduced the use of multiple voice coils in a single loudspeaker. Dual voice coil subwoofers, as are known in the art, have two separate windings mounted to a common bobbin and cone. Such loudspeakers are frequently used in car audio applications for increased flexibility in wiring. While power handling levels, frequency response, and other parameters remain the same whether connected in series or in parallel, the impedance "seen" by the audio signal source changes.

To enable multiple loudspeakers or multiple voice coil elements in a single loudspeaker to be easily connected in parallel or in series, devices such as the terminal block disclosed in U.S. Pat. No. 6,656,000 to Abdo have been developed. The Abdo device has one embodiment that was essentially a pair of metallic blocks, a first block being electrically connected to a positive line from the audio signal source and a second block being electrically connected to a negative line from the audio signal source. The first block includes a pair of output terminals to be connected to the respective one of positive wires of the loads (voice coil element). The second block likewise includes a pair of output terminals to be connected to the respective one of negative wires of the loads. Such first embodiment is operative to connect the loads in parallel. A second embodiment includes essentially the same components, but includes only one output terminal for each block. Thus, the positive wire of one of the loads is connected to the first block, the negative wire of the one of the loads is connected to the positive wire of the other load, and the negative wire of the other load is connected to the second block, connecting the loads in series.

As will be appreciated by an artisan having ordinary skill in the art, the Abdo device and other like devices essentially provides an accessible central junction for connecting the audio signal source and the wires of the loads. However, such prior devices are deficient in that it is still necessary to handle the actual wires of the loads to alter the configuration between series wiring and parallel wiring. Additionally, it is necessary to substitute different terminal blocks to switch between series wiring and parallel wiring. One major difficulty experienced by consumers in altering the configuration of loudspeakers is the clutter associated with handling the wires, and being unable able to ascertain whether the proper connections have been made. Therefore, there is a need in the art for an improved terminal assembly which can more readily switch the wiring configuration of electrical loads from parallel to series, and vice versa.

BRIEF SUMMARY OF THE INVENTION

In accordance with the present invention, there is provided a terminal assembly for coupling a plurality of electrical loads to a source. The terminal assembly may include a circuit board defining a first section and a second section, with a first set of jumper contacts disposed on the first section and a second set of jumper contacts disposed on the second section. The first set of jumpers contacts, cooperating with jumpers attached thereto may connect the electrical loads in parallel. Further, the second set of jumper contacts, in cooperation with jumpers attached thereto may connect the electrical loads in series. A housing may be disposed on the circuit board, and define a jumper access aperture which may overlap the first and second sections of the circuit board. A cover may be positioned on the jumper access aperture to selectively expose the first set of jumper contacts and the second set of jumper contacts. Thus, the present invention represents a substantial departure from and provides significant advantages over conventional terminal block assemblies. The present invention is best understood with reference to the following detailed description read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION OF THE INVENTION

The detailed description set forth below in connection with the appended drawings is intended as a description of the presently preferred embodiment of the invention, and is not intended to represent the only form in which the present invention may be constructed or utilized. The description sets forth the functions and the sequence of steps for developing and operating the invention in connection with the illustrated embodiment. It is to be understood, however, that the same or equivalent functions may be accomplished by different embodiments that are also intended to be encompassed within the spirit and scope of the invention. It is further understood that the use of relational terms such as first and second, top and bottom, and the like are used solely to distinguish one from another entity without necessarily requiring or implying any such actual relationship or order between such entities.

Figure 1:
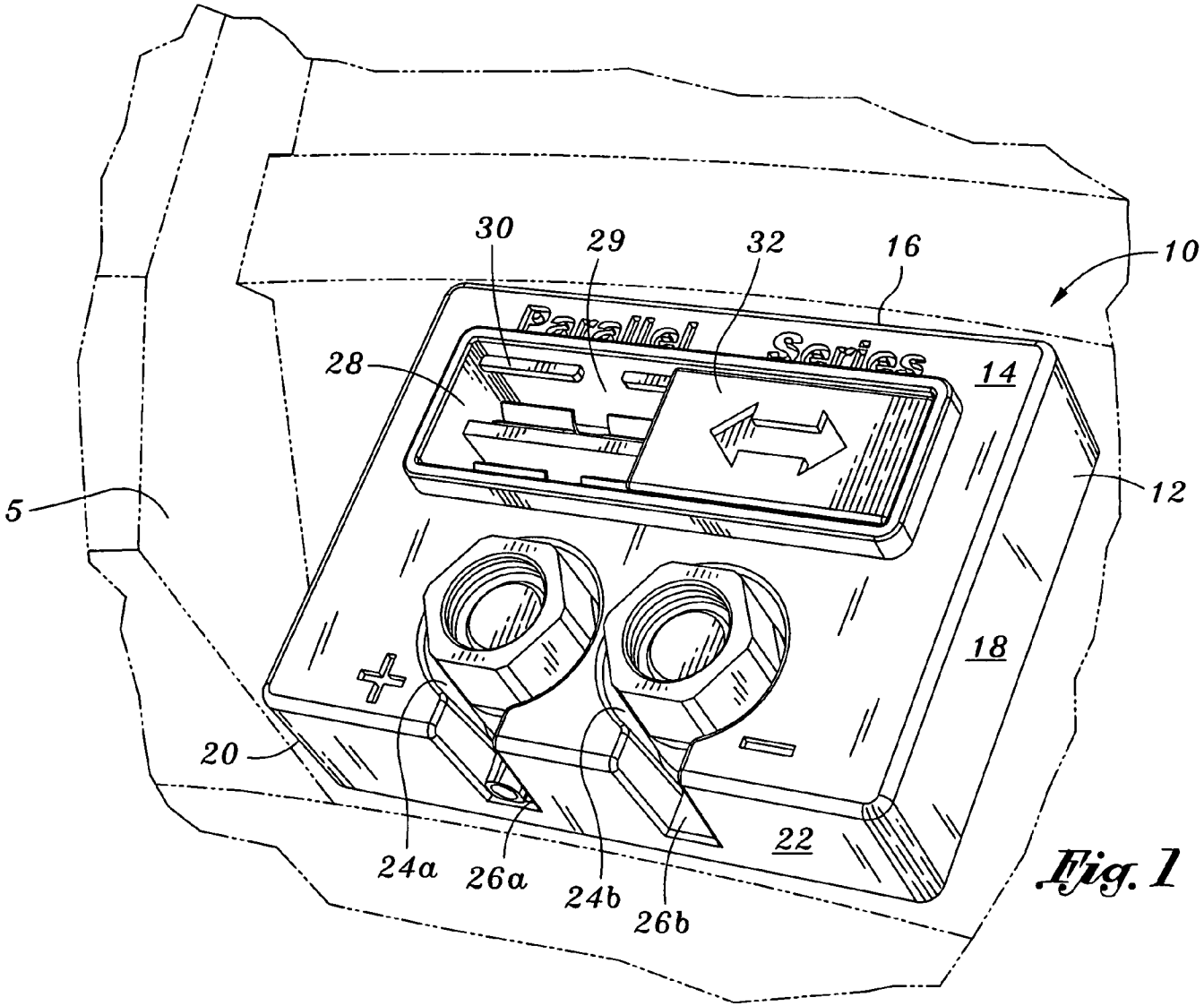
FIG. 1 is a perspective view of a terminal assembly in accordance with the present invention as attached to a loudspeaker.

With reference now to FIG. 1, according to the present invention there is provided a terminal assembly 10 which includes a housing 12 defined by a front face 14, an upper surface 16, a right side surface 18, a left side surface 20, and a lower surface 22. The front face 14 includes a pair of terminal cap receiving bores 24*a* and 24*b* contiguous with a corresponding pair of wire access slots 26*a* and 26*b*. The wire access slots 26*a*, 26*b* are also defined by the lower surface 22. The front face 14 also defines a jumper access aperture 28 which exposes the interior of the housing 12, and includes a cover track 30 disposed on the periphery of the jumper access aperture 28. The jumper access aperture 28 is also defined by cavity walls 29. An aperture cover 32 is slidably engaged to the housing 12 on the jumper access aperture 28, particularly along the track 30. It is understood that the sliding aperture cover 32 is provided by way of example only and not by way of limitation. Any other mechanism for selectively exposing sections of the interior of the housing 12 is deemed to be within the scope of the present invention.

While FIG. 1 illustrates the terminal assembly 10 being attached to a loudspeaker 5, a person of ordinary skill in the art will readily appreciate that the terminal assembly 10 may be attached to any suitable location such as speaker boxes, stereo receivers, and the like. Such person will also recognize that the shape and the respective surfaces of the housing 12 need not be limited to that just described, and may be in the form of any desirable shape which may increase its aesthetic appeal.

Figure 2:
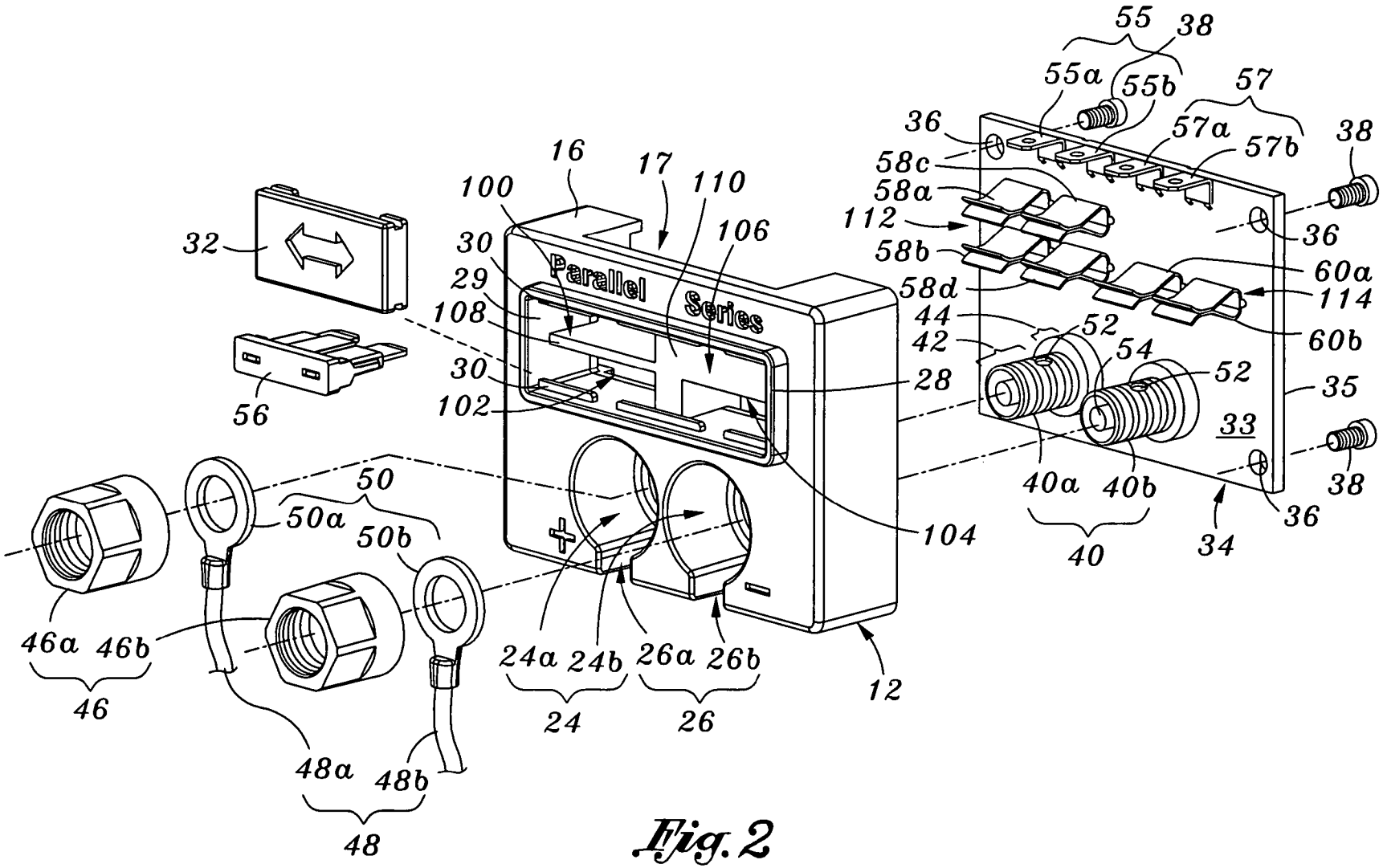
FIG. 2 is an exploded perspective view of the terminal assembly.

An exploded view of the terminal assembly 10 is shown in FIG. 2, including the housing 12 configured to partially enclose a circuit board 34. As illustrated in FIG. 1, the cavity walls 29 extend to be substantially flush with the circuit board 34. The circuit board 34 may be of a quadrangular shape having a front side 33 and a back side 35, and include various etched traces and through holes, as well as a set of housing attachment holes 36 disposed on the corners of the circuit board 34. It is understood that the circuit board 34 may be secured to the housing 12 by utilizing screws 38 threaded through the housing attachment holes 36 and the housing 12.

The circuit board 34 includes a pair of source terminals 40, particularly positive source terminal 40*a* and negative source terminal 40*b*. The source terminals 40 are each defined by a threaded post section 42 and a cylindrical base section 44. Although not shown, the source terminals 40 each include an attachment section inserted through the circuit board 34 and secured thereon. It is understood that the attachment section may be threaded, and a nut threaded thereon may secure the source terminals 40 to the circuit board 34. However, any of the numerous conventional fastening means may be substituted. It will be understood by those having ordinary skill in the art that the constituent parts of the source terminals 40 including the post section 42, the base section 44, and the attachment section are of a unitary construction. It will be further understood that the source terminals 40 are constructed of material that is capable of conducting electricity, particularly, metal.

With the housing 12 enclosing the circuit board 34, the source terminals 40 project through the terminal cap receiving bores 24. A pair of terminal caps 46 cooperates with the source terminals 40 to secure a pair of source wires 48. As illustrated in FIG. 2, the source wires 48 each include ring terminations 50 which are configured to be fitted on the post section 42 of the source terminals 40. In this regard, the slightly larger diameter of the cylindrical base section 44 in relation to the post section 42 facilitates a greater contact surface area between the ring terminations 50 and the source terminals 40. Alternatively, the ring terminations 50 may be omitted and the source wires 48 may be bare such that they may be inserted into a wire access hole 52 defined by the source terminals 40. In either configuration, the terminal caps 46 clamp the source wires 48 to the source terminals 40. It will be appreciated that the ring terminations 50 may be utilized for more permanent connections as repeatedly unscrewing the terminal caps 46 may prove to be cumbersome, while bare wire connections may be utilized where rapid insertion and removal (for example, in testing situations) is desired. One of ordinary skill in the art will recognize that inserting the bare source wires 48 into the wire access holes 52 in the foregoing manner may result in undesirable fraying of the ends of the source wires 48. In order to avoid this, banana plugs may serve as terminations to the source wires 48 instead, and inserted into the hollow portion 54 of the source terminals 40. The opposite end of the source wires 48 are understood to be connected to terminals on an electrical signal source, such as a stereo receiver, radio receiver, audio amplifier, and the like. As is well known in the art, such signal sources include a positive terminal and a negative terminal, and the positive source wire 48*a* and the negative source wire 48*b* are connected respectively thereto.

It is understood that in order to decrease the profile of the terminal assembly 12, the source terminals 40 do not project any further from the front face 14 than necessary, and the corresponding terminal caps 46 are disposed within the terminal cap receiving bores 24. To permit the terminal caps 46 to clamp the source wires 48 while minimizing the overall profile, access to the lower portions of the source terminals 40 is provided through the wire access slots 26. It will be recognized by one of ordinary skill in the art that numerous other configurations which minimize the profile of the terminal assembly 12 are possible, and any such configuration may be readily substituted without departing from the scope of the present invention.

The terminal assembly 10 is configured to interconnect electrical loads to the aforementioned signal source. The electrical loads are typically understood to include positive leads and negative leads and, by way of example only and not of limitation, may be a voice coil of loudspeakers. In the particular embodiment illustrated in FIG. 2, there are intended to be two sets of positive and negative leads to be interconnected via the terminal assembly 10. In such an embodiment, there may be a pair of voice coil windings within a single acoustic transducer or loudspeaker, or there may be a pair of loudspeakers each having a single voice coil winding. To connect such a pair of electrical loads, there is a first load positive terminal 55*a* and a first load negative terminal 55*b*, generally referred to as first load terminals 55, and a second load positive terminal 57*a* and a second load negative terminal 57*b*, generally referred to as second load terminals 57. The first load terminals 55 and the second load terminals 57 are attached to the edge of the circuit board 34, and partially protrude from the back side 35 thereof. In order to provide unobstructed access to the first load terminals 55 and the second load terminals 57, the upper surface 16 of the housing 12 defines a load terminal access slot 17. While each of the first and second load terminals 55 and 57 are illustrated as plates with holes, a person having ordinary skill in the art will appreciate that any suitable electrically conductive mechanism may be substituted.

Turning now to the other components disposed on the circuit board 34, there is a set of jumper contacts which, in cooperation with jumpers 56, establish a parallel or series connection between the electrical loads connected to first load terminals 55 and the second load terminals 57 of the terminal assembly 10. More particularly, there is a first parallel circuit jumper contact 58*a*, a second parallel circuit jumper contact 58*b*, a third parallel circuit jumper contact 58*c*, and a fourth parallel circuit jumper contact 58*d*, which are generally referred to as parallel circuit jumper contacts 58. Additionally, there is a first series circuit jumper contact 60*a*, and a second series circuit jumper contact 60*b*, generally referred to as series circuit jumper contacts 60. Further details relating to the underlying circuit which enable the parallel and series connection will be discussed below.

Figure 3:
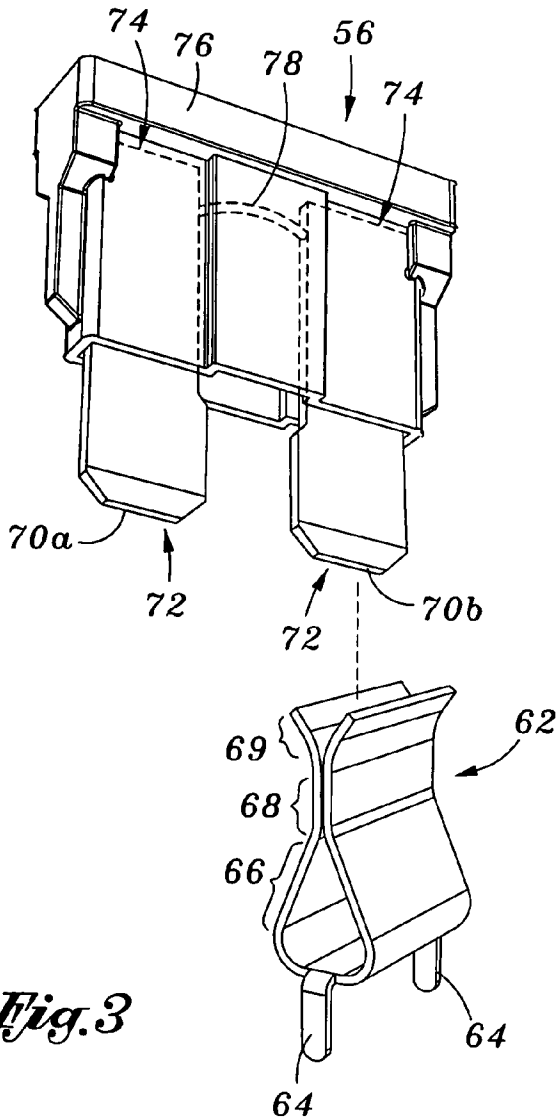
FIG. 3 is a perspective view of a jumper and a first embodiment of a jumper contact, the jumper being positioned above and ready for insertion into the jumper contact.

With reference to FIG. 3, further details of a generic jumper contact 62 will now be considered in conjunction with the conventional jumper 56. It will be understood that the jumper contact 62 is identical in structure and function to each of the parallel circuit jumper contacts 58 and the series circuit jumper contacts 60. The jumper contact 62 includes a pair of opposed circuit board attachment members 64, which are configured to be inserted into the circuit board 34 and protrude from the back side 35 thereof. The jumper contact 62 may be electrically and mechanically connected with solder to the various metallic regions of the back side 35 of the circuit board 34. The circuit board attachment members 64 are contiguous with a bent lower end 66, which is operative to impart a compressive force upon an electrode 70 at a clamping region 68 to retain the same. The clamping region 68 is planar to maximize the contact surface area with the electrode 70, and thus maximizing retention strength. A top end 69 is bowed out such that the electrode 70 may readily slide into the clamping region 68 with minimal force. One jumper contact 62 links in complementary fashion to one of the electrodes 70 of the jumper 56. The jumper 56 includes a first electrode 70*a* and a second electrode 70*b*, with bottom ends 72 thereof being exposed and top ends 74 being covered by a jumper housing 76. Within the jumper housing 76 is a metal strip 78 that electrically connects the first electrode 70*a* to the second electrode 70*b*. It will be appreciated that the metal strip 78 may provide over-current protection by melting when heated by excessive current, thereby breaking the circuit.

Figure 4A:
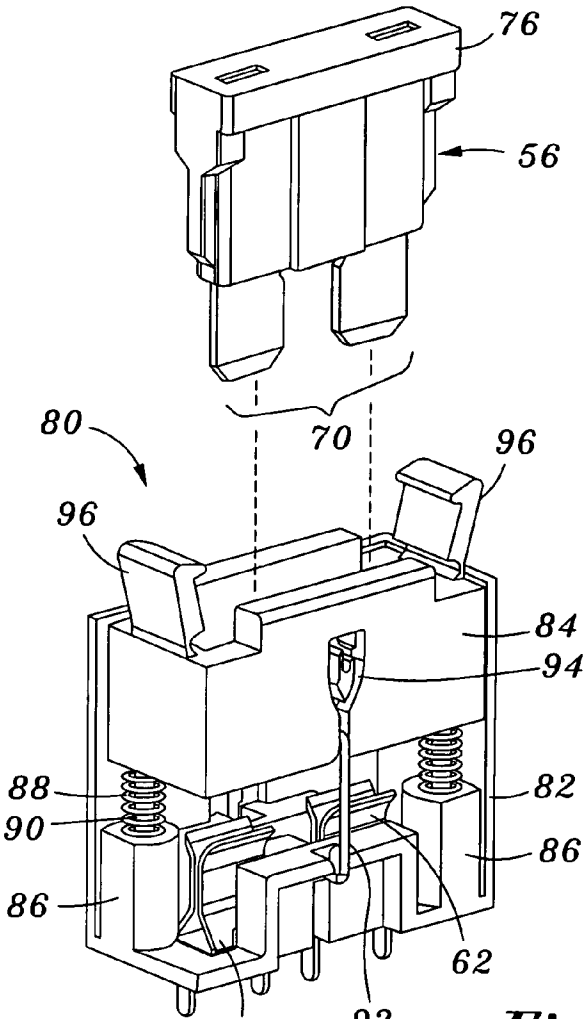
FIG. 4*a* is a perspective view of a first embodiment of a quick release device incorporated with the jumper contact.
Figure 4C:
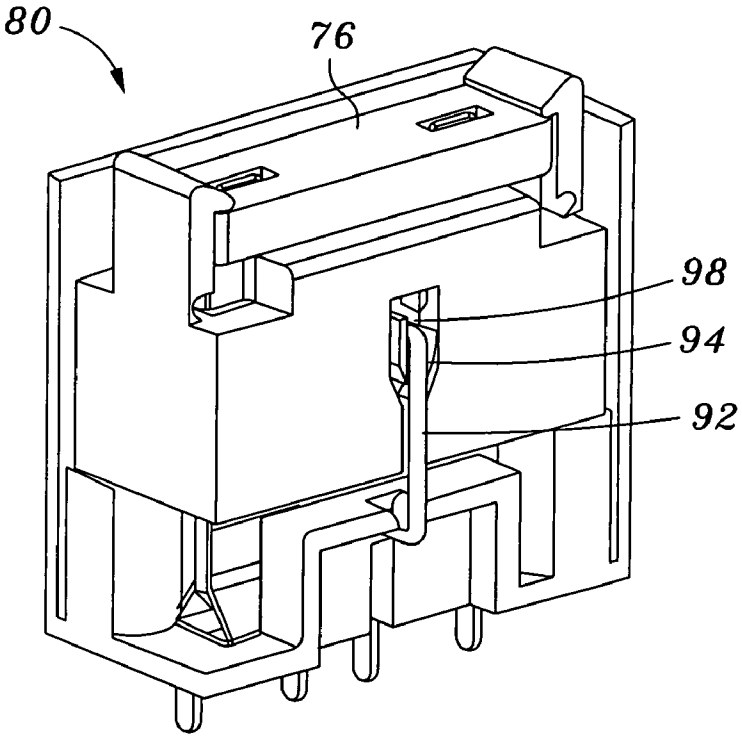
FIG. 4*c* is a perspective view of the first embodiment of the quick release device upon releasing the jumper from the jumper contact.
Figure 4B:
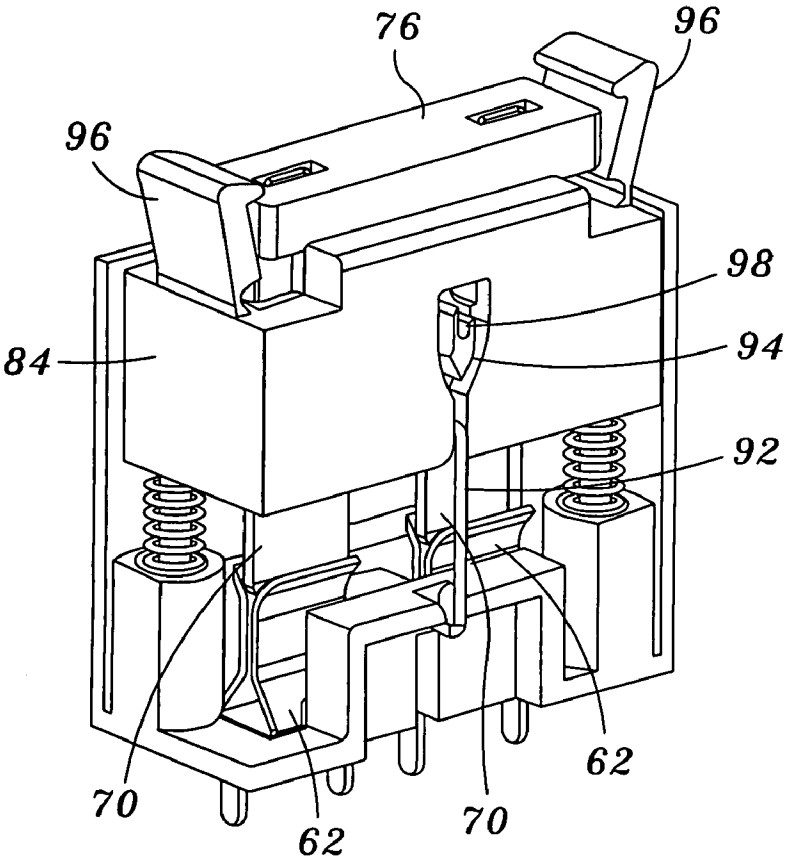
FIG. 4*b* is a perspective view of the first embodiment of the quick release device engaged to hold the jumper within the jumper contact.

In the aforementioned basic configuration where the jumper 56 is manually pushed in and pulled out from the jumper contact 62, the jumper 56 must project from the front face 14 of the housing 12 such that access to the jumper 56 is not inhibited. In an alternative configuration illustrated in FIGS. 4*a*-4*c*, a pair of jumper contacts 62 are also provided, but are enclosed in a first quick release device 80. The first quick release device 80 includes a sleeve portion 82 mated to a jumper holding member 84. The sleeve portion 82 includes a pair of diagonally opposed hollow cylinders 86 for receiving a spring 88 and a piston 90 integral with the jumper holding member 84. The jumper holding member 84 has two stationary positions relative to the sleeve portion 82, facilitated by a connecting rod 92. The expansive forces of the spring 88 push the jumper holding member 84 upwards so that the connecting rod 92 is at the lowest portion of a locking groove 94. FIGS. 4*a* and 4*b* illustrate this initial position, FIG. 4*a* without the jumper 56 inserted, and FIG. 4*b* with the jumper 56 inserted.

Upon inserting the jumper 56 within the holding member 84, a pair of opposed clamps 96 close against the jumper housing 76. By applying further force to the jumper 56, the electrodes 70 are inserted into the jumper contacts 62, and the connecting rod 92 is driven further upwards into the locking groove 94. As illustrated in FIG. 4*c*, the connecting rod 92 is engaged to a locking surface 98, and impedes the exertion of the expansive forces of the springs 88 upon the jumper holding member 84. When removal of the jumper 56 is required, it is pushed in again, disengaging the connecting rod 92 from the locking surface 98. Thus, the connecting rod 92 travels through the locking groove 94, in effect raising the jumper 56 and the jumper holding member 84 via the expansive forces of the springs 88. As will be appreciated, this embodiment does not require that the jumper 56 project from the front face 14 of the housing 12 because the jumpers 56 must merely be pushed (and not grasped by the jumper housing 76) to insert and remove the same. In this regard, the height of the jumper 56 may be reduced, decreasing the overall profile of the terminal assembly 10.

Figure 5:
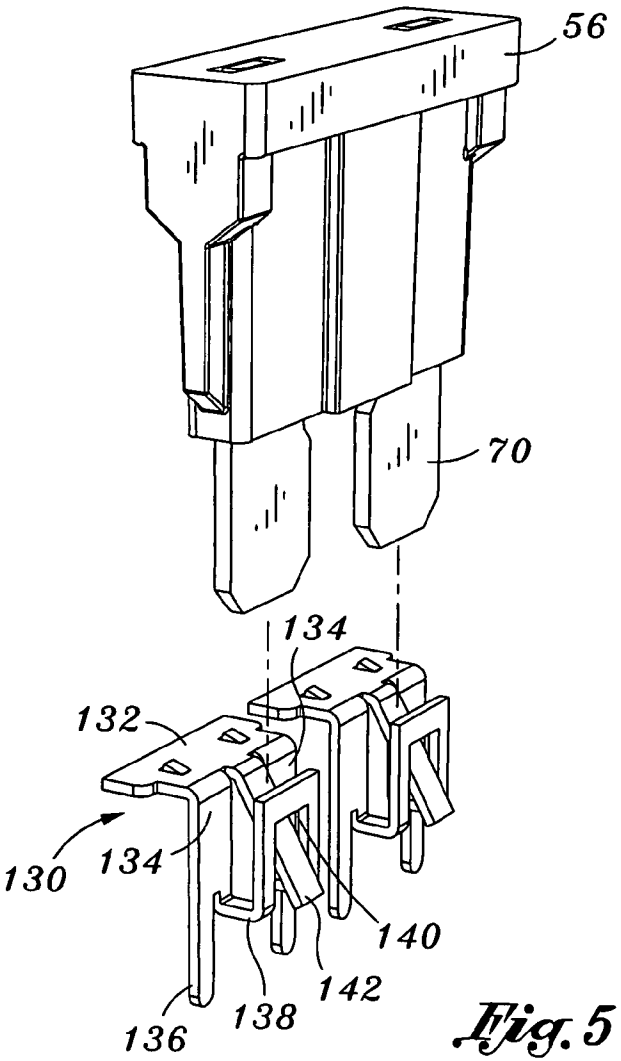
FIG. 5 is a perspective view of the jumper and a second embodiment of the jumper contact.

In another embodiment of the present invention, there is envisioned an alternative configuration for the quick release device and accompanying jumper contacts. With reference to FIG. 5, a jumper contact 130 for use in such configuration is illustrated, including a base plate 132 and a pair of legs 134 extending perpendicularly therefrom. The legs 134 each have a circuit board attachment member 136 that are configured to be inserted into the circuit board 34. A gripping bracket 138 is attached to the legs 134, and includes a slot 140. A finger 142 fixed to the base plate 132 extends into the slot 140 so as to define an intersecting relationship between the gripping bracket 138 and the finger 142. It will be understood that the jumper contact 130 is constructed of a flexible metallic material, such that the finger 142 may readily flex to accommodate the electrode 70 of the jumper 56 upon insertion, and to impart a compressive force thereon.

Figure 6A:
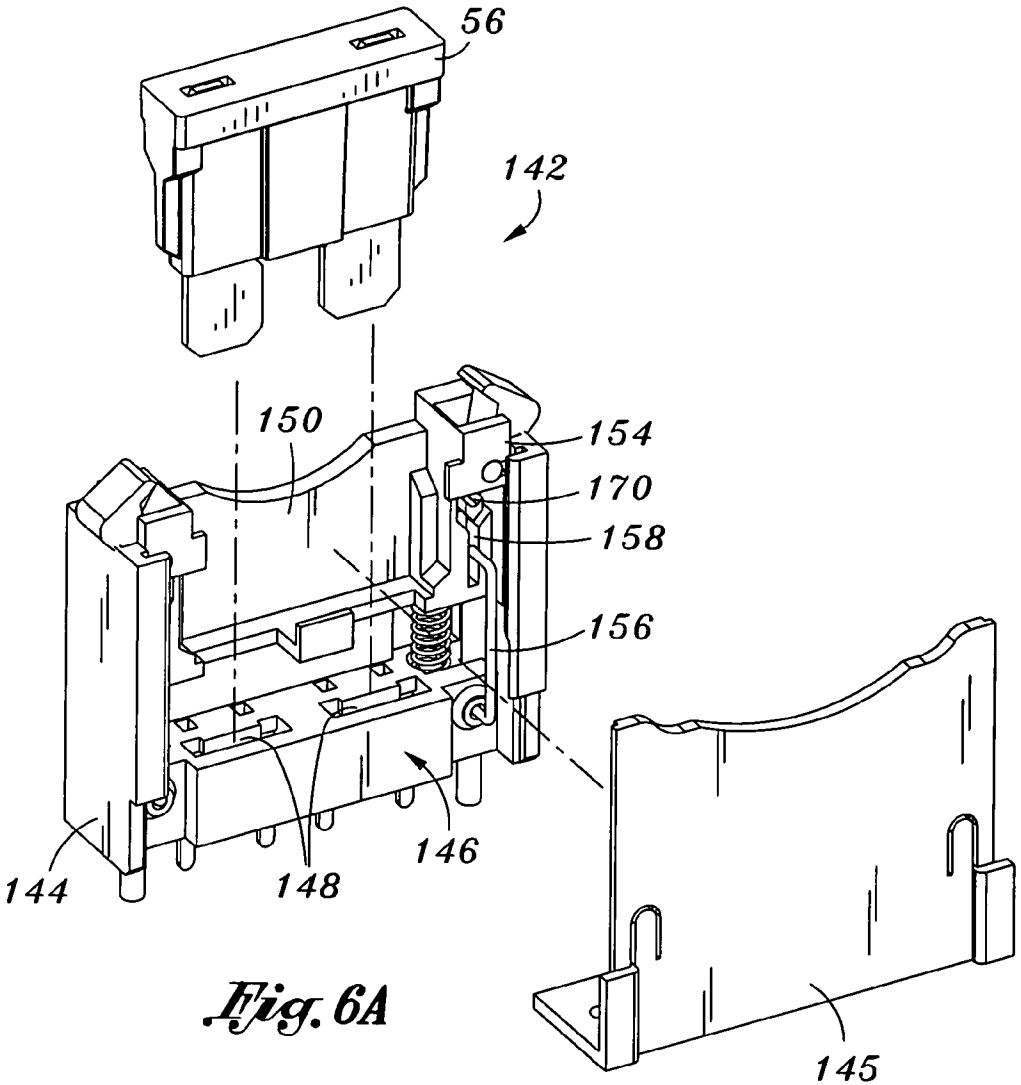
FIG. 6*a* is a partial exploded perspective view of a second embodiment of the quick release device with the jumper positioned for insertion therein.
Figures 6B, 6C:
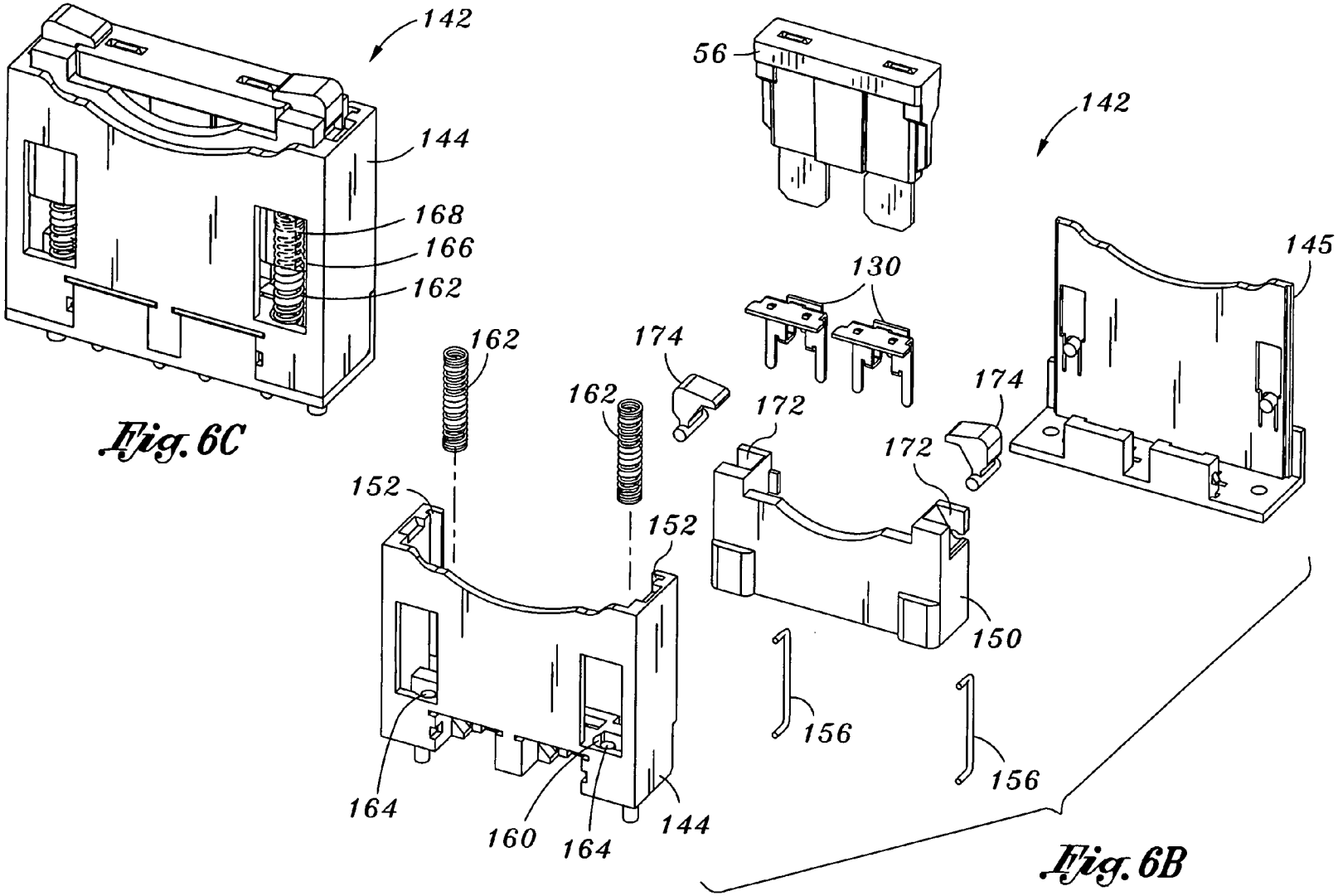
FIG. 6*b* is an exploded perspective view of the second embodiment of the quick release device.
FIG. 6*c* is a perspective view of the second embodiment of the quick release device with the jumper inserted therein.

With reference to FIGS. 6A, 6B, and 6C, a second quick release device 142 is illustrated. There is a body 144 including a base section 146 defining a pair of contact access apertures 148, and a cover 145 attached thereto. Within the contact access apertures 148 are the jumper contacts 130. Mated to and in a sliding relationship with the body 144 is a jumper holding member 150. Particularly, the body includes tracks 152 that provide a guide for the rails 154 on the jumper holding member 150. A connecting rod 156 is attached to each of the peripheral ends of the body 144, and slides along a locking groove 158. Each peripheral side of the body 144 includes a spring receptacle 160 configured to retain a spring 162. The spring receptacle 160 on the body 144 includes a lower pin 164 to further secure the spring 162 and to prevent deformation thereof under compression or expansion. Further, on each peripheral side of the jumper holding 150 includes a spring receptacle 166 having an upper pin 168 disposed therein. The spring receptacle 166 and the upper pin 168 on the jumper holding member 150 is understood to be coaxial to the spring receptacle 160 and the lower pin 164 on the body 144. In operation, the spring 162 imparts an expansive force, such that the jumper holding member 150 is pushed upwards from the body 144. The upwards motion is limited by the connecting rod 156 and the lower end of the locking groove 158. Upon inserting the jumper 156, the connecting rod 156 travels up the locking groove 158 and engages the locking surface 170. Further, on each peripheral side of the jumper holding member 159 there is a notch 172 for rotatably mounting a clamp 174. With the jumper 56 inserted within the quick release device 142, it is understood that the clamp 174 functions to grip the jumper 56, thereby preventing the manual removal of the same.

It will be recognized by one of ordinary skill in the art that the functionality of the second quick release device 142 and the first quick release device 80 are generally comparable. The second quick release device 142 may provide additional advantages such as decreased profile, since the locking groove 158 and the connecting rod 156 have been shifted from the center to the periphery. Along these lines, the particular configuration in which the body 144 Further, the jumper contact 130 may also facilitate the reduction in thickness of the second quick release device 142, as it is not required to flex outwards beyond its normal state.

It will be appreciated that while particular quick release mechanisms have been described, any like mechanism may be readily substituted without departing from the scope of the present invention. A person having ordinary skill in the art will be able to readily ascertain such alternative mechanisms.

Referring back to FIG. 2, the parallel circuit jumper contacts 58 and the series circuit jumper contacts 60 are arranged on the circuit board 34 to extend through the jumper access aperture 28 of the housing 12 with the circuit board 34 attached thereto. The jumper access aperture 28 can be divided into a first quadrant 100 for the first parallel circuit jumper contact 58*a* and the third parallel circuit jumper contact 58c. Further, the jumper access aperture 28 has a second quadrant 102 for the second parallel circuit jumper contact 58*b* and the fourth parallel circuit jumper contact 58*d*. The jumper access aperture 28 also has a third quadrant 104 for the first series circuit jumper contact 60*a* and the second series circuit jumper contact 60*b*. Since there is no jumper contact associated with the fourth quadrant 106, the housing 12 is molded such that no access to the circuit board 34 is possible. Henceforth, that area of the circuit board 34 overlapping the first quadrant 100 and the second quadrant 102 will be referred to as the first section 112 and the area of the circuit board 34 overlapping the third quadrant 104 will be referred to as the second section 114. The quadrants are separated by a horizontal divider 108 and a vertical divider 110. As described above, the aperture cover 32 is slidably engaged to the tracks 30 defined by the periphery of the jumper access aperture 28. The aperture cover 32 is sized to cover only half of the jumper access aperture 28, such that access to the first quadrant 100 and the second quadrant 102 is simultaneously provided while blocking access to the fourth quadrant 106, and vice versa.

Figure 7:
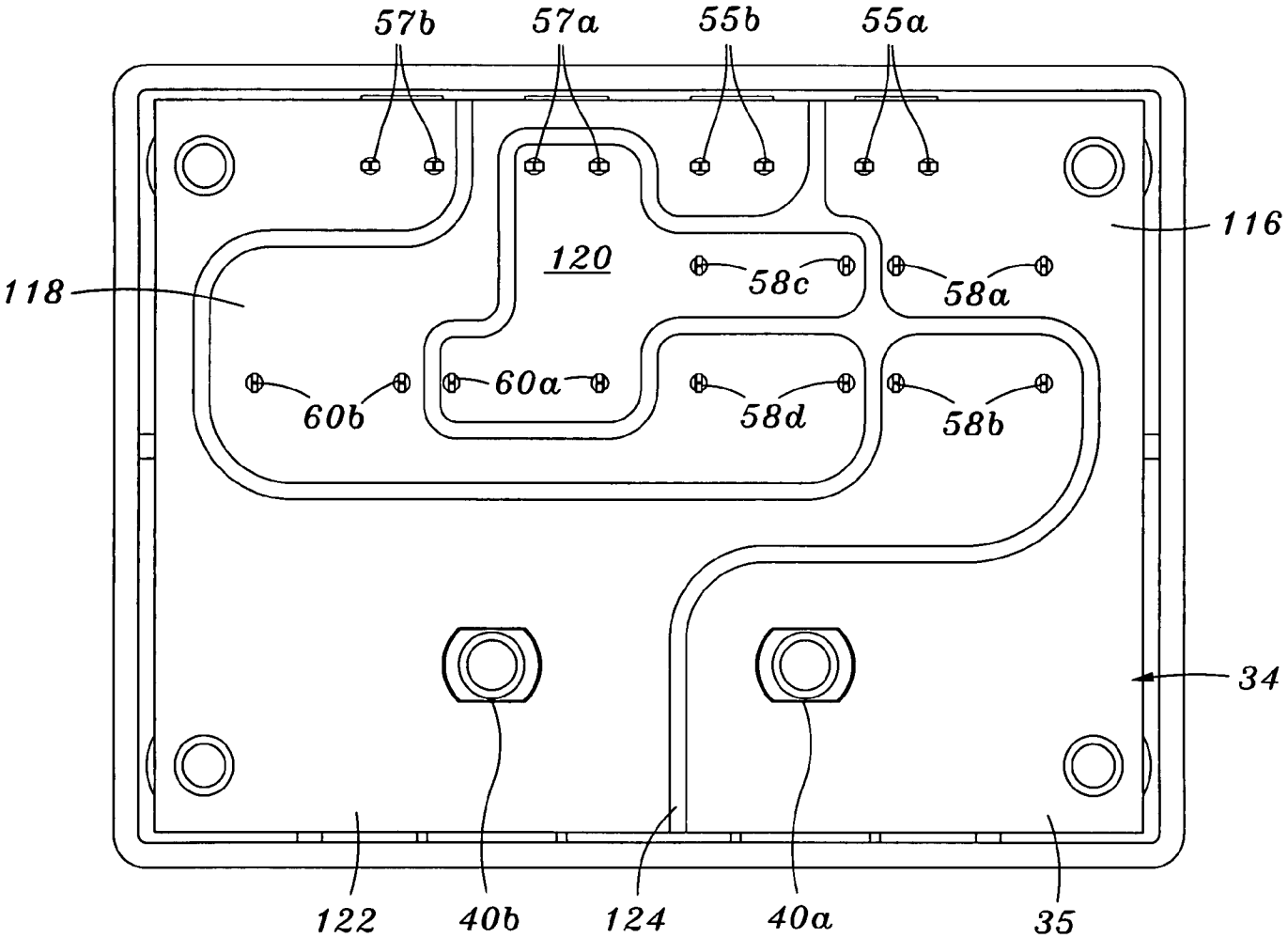
FIG. 7 is a rear plan view of a circuit board in accordance with the present invention illustrating various circuit regions.

The modality by which the electrical loads are coupled in parallel and series to the electrical signal source will become apparent upon consideration of the back side 35 of the circuit board 34 with reference now to FIG. 7. According to one embodiment, the first load positive terminal 55*a*, first parallel circuit jumper contact 58*a*, and the positive source terminal 40*a* are in electrical communication with each other via a first circuit region 116. Furthermore, a second circuit region 118 electrically interconnects the first load negative terminal 55*b*, the second series circuit jumper contact 60*b*, and the fourth parallel circuit jumper contact 58*d*. A third circuit region 120 electrically interconnects the second load positive terminal 57*a*, the first series circuit jumper contact 60*a*, and the third parallel circuit jumper contact 58*c*. Finally, a fourth circuit region 122 electrically interconnects the second load negative terminal 57*b*, the second parallel circuit jumper contact 58*b*, and the negative source terminal 40*b*. The depiction of the circuit board 34 in FIG. 7 references multiple entities as the respective one of the jumper contacts. Such jumper contacts, including the exemplary jumper contact 62 illustrated in FIG. 3, include a pair of circuit board attachment members 64. These members are understood to correspond to the entities depicted in FIG. 7. Similarly, those entities referenced as the load terminals 126, 128 also include a pair of members associated therewith which are configured to be attached to the circuit board 35.

It will be understood that the circuit board 34, and particularly the backside 35 thereof, is a conductive plating laminated on an underlying, non-conductive substrate prior to etching. One of ordinary skill in the art will appreciate that the conductive plating is a sheet of copper or other like metal, and the substrate may comprise phenolic resin, fiberglass reinforced with epoxy resin, ceramics, and so forth. After processing, etchings 124 are made to define the first circuit region 116, the second circuit region 118, the third circuit region 120, and the fourth circuit region 118, and to electrically isolate one circuit region from another. More particularly, the conductive plating on the regions of the circuit board 34 for the etchings 124 are removed so that the non-conductive substrate is exposed and there are no mechanical connections across the etchings 124. The techniques involved with developing the etchings 124 are well known in the art, and numerous techniques not mentioned above to accomplish the same ends may be readily substituted without departing from the scope of the present invention.

Figure 9:
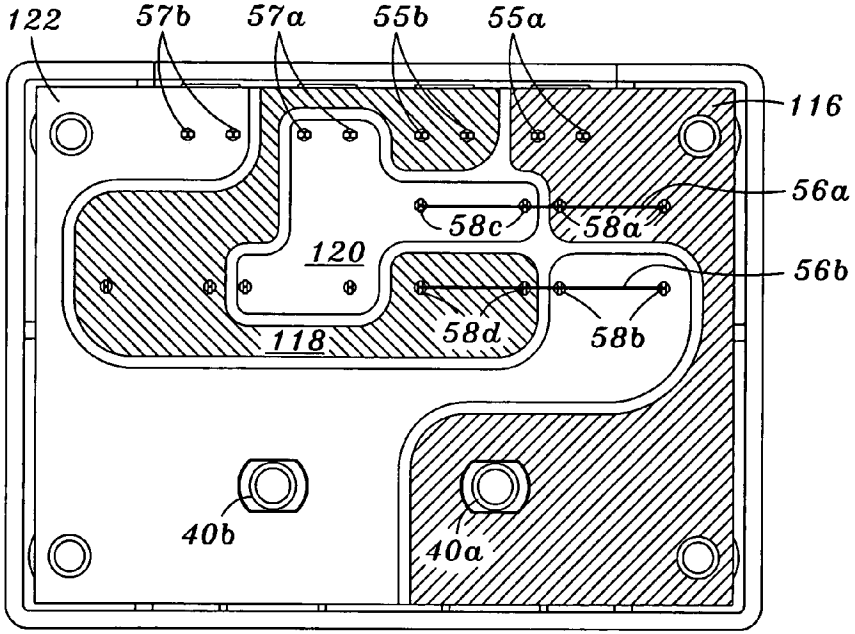
FIG. 9 is a rear plan view of the circuit board showing the connections made between the regions of the circuit board and the connections resulting in the output terminals of the terminal assembly being coupled in parallel.
Figure 8:
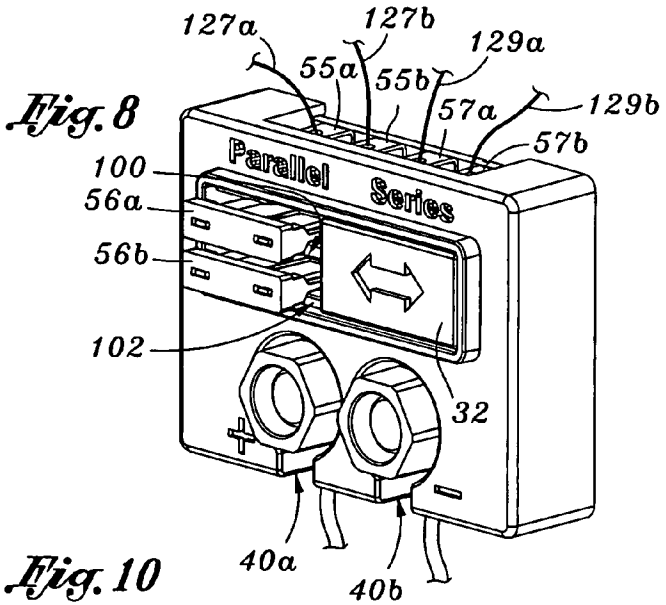
FIG. 8 is a perspective view of the terminal assembly with jumpers inserted to connect output terminals in parallel relative to source terminals.
Figure 10:
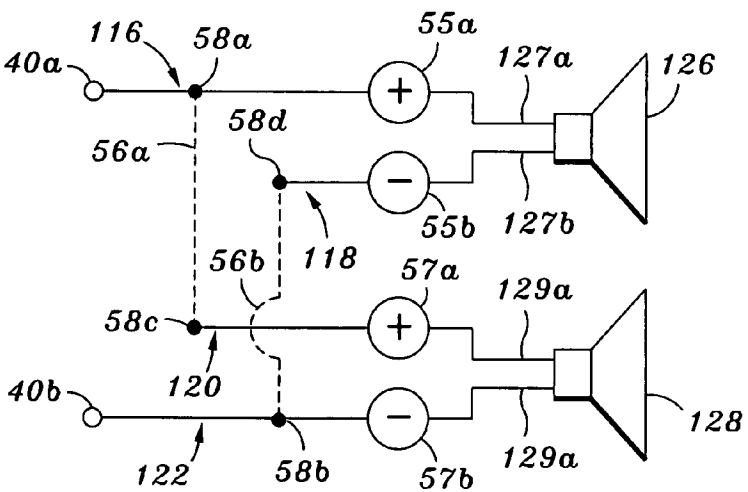
FIG. 10 is a diagram of the circuit board showing the electrical loads connected in parallel.

With the understanding of the layout of the circuit board 34, the connections made by attaching the jumpers to the contacts to link the aforementioned circuit regions and how such connections enable a parallel or series couplings of the electrical loads will now be described. Referring now to FIG. 8, the terminal assembly 10 is shown with the positive and negative source terminals 40*a*, 40*b* connected to an electrical signal source (not shown). The cover 32 is positioned such that the first and second quadrants 100, 102, and specifically the first section 112 of the circuit board 34, as shown in FIG. 2, are exposed. Referring now to FIGS. 8, 9 and 10, a first jumper 56*a* is inserted into the first parallel circuit jumper contact 58*a* and the third parallel circuit jumper contact 58*c*, connecting the first circuit region 116 to the third circuit region 120. Thus, the positive source terminal 40*a* is electrically connected to the first load positive terminal 55*a* and the second load positive terminal 57*a*. A second jumper 56*b* is inserted into the second parallel circuit jumper contact 58*b* and the fourth parallel circuit jumper contact 58*d*, thereby connecting the second circuit region 118 to the fourth circuit region 122. The negative source terminal 40*b* is coupled to the first load negative terminal 55*b* and the second load negative load terminal 57*b*.

As shown in FIG. 10, a positive lead 127*a* of a first load 126 is coupled to the first load positive terminal 55*a*, and a negative lead 127*b* of the first load 126 is coupled to the first load negative terminal 55*b*. Further, a positive lead 129*a* of a second load 128 is coupled to the second load positive terminal 57*a*, and a negative lead 129*b* of the second load 128 is coupled to the second load negative terminal 57*b*. In the circuit formed as described hereinbefore, the positive lead 127*a* of the first load 126 and the positive lead 129*a* of the second load 128 share a connection to the positive source terminal 40*a*. The negative lead 127*b* of the first load 126 and the negative lead 129*b* of the second load 128 are connected to the negative source terminal 40*b*. In this regard, the first load 126 is understood to be connected in parallel to the second load 128. It will be appreciated that the particular configuration of the first, second, third, and fourth circuit regions 116, 118, 120, and 122 enable the parallel circuit jumper contacts 58 to be grouped into the first section 112 of the circuit board 34, and to be disposed thereon in alignment with the first quadrant 100 and the second quadrant 102 of the housing 12.

Figure 12:
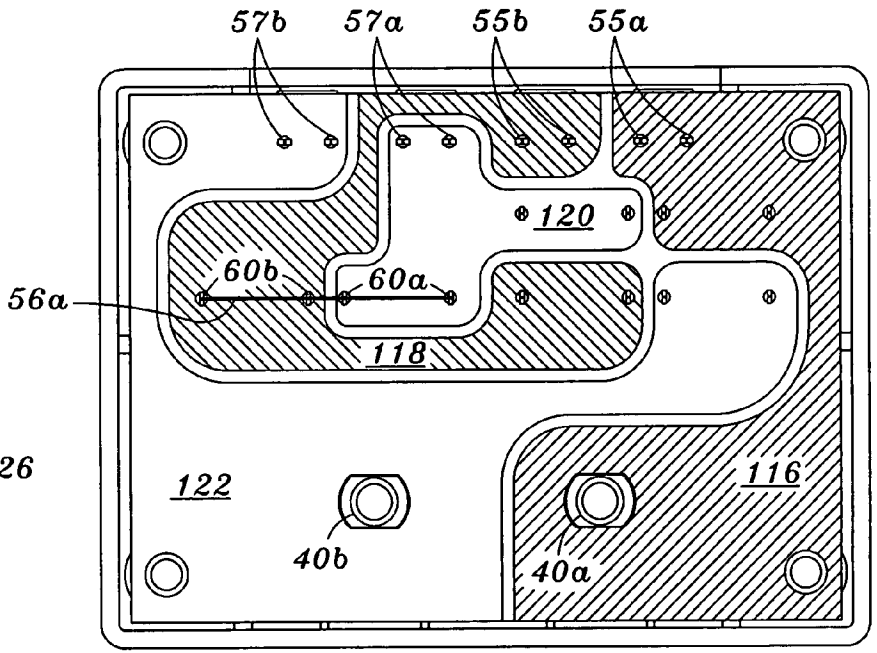
FIG. 12 is a rear plan view of the circuit board showing the connections made between the regions of the circuit board and the connections resulting in the output terminals of the terminal assembly being coupled in series.
Figure 11:
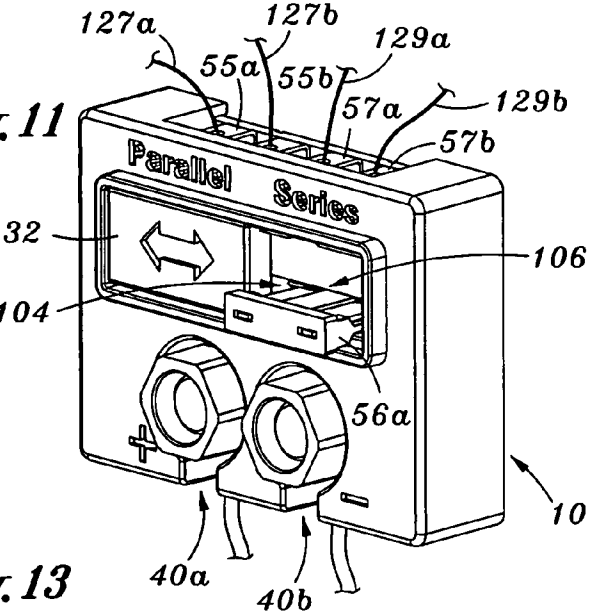
FIG. 11 is a perspective view of the terminal assembly with one jumper inserted to connect the output terminals in series relative to the source terminals.
Figure 13:
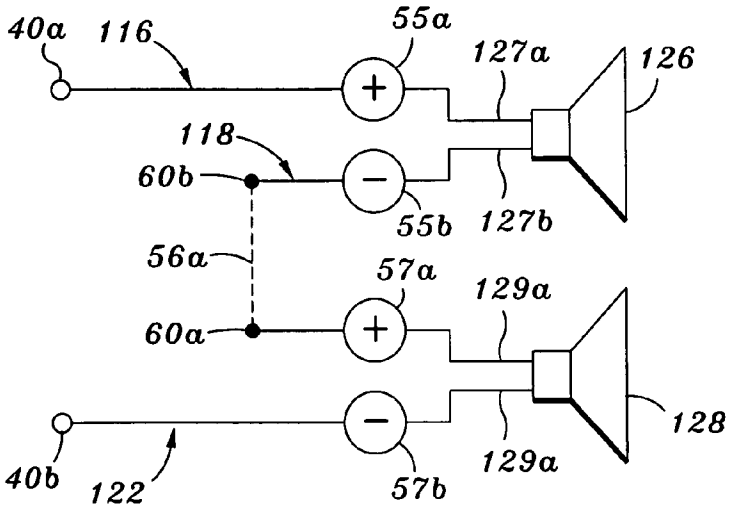
FIG. 13 is a diagram of the circuit board showing the electrical loads connected in series.

Turning now to FIG. 11, the terminal assembly 10 is again illustrated with the positive and negative source terminals 40*a*, 40*b* connected to an electrical signal source (not shown). The cover 32 is positioned to expose the third quadrant 104 and the fourth quadrant 106, specifically, the second section 114 of the circuit board 34 as shown in FIG. 2. As understood, when the cover 32 fully exposes the third quadrant 104 and the fourth quadrant 106, the first quadrant 100 and the second quadrant 102 are fully covered. Referring now to FIGS. 12 and 13, the first load positive terminal 55*a* electrically connects the positive lead 127*a* of the first load 126 to the positive source terminal 40*a*. The negative lead 127*b* of the first load 126 is connected to the first load negative terminal 55*b* on the second circuit region 118. With the first jumper 56*a* inserted into the first series circuit jumper contact 60*a* and the second series circuit jumper contact 60*b*, the second circuit region 118 is electrically connected to the third circuit region 120. The positive lead 129*a* of the second load 128 is connected to the second load positive terminal 57*a*, which as mentioned before, is connected to the third circuit region 120. The negative lead 129*b* of the second load 128 is connected to the second load negative terminal 57*b*, which is connected to the fourth circuit region 122, and thus, the negative source terminal 40*b*. As will be recognized by one of ordinary skill in the art, the aforementioned circuit formed by inserting the first jumper 56*a* into the first and second series circuit jumper contacts 60*a* and 60*b* is operative to connect the first load 126 in series with the second load 128. It will be further recognized that the particular configuration of the first, second, third, and fourth circuit regions 116, 118, 120, and 122 enable the series circuit jumper contacts 60 to be grouped into the second section 114 of the circuit board 34, and disposed on the same in alignment with the third quadrant 104 of the housing 12.

As explained above, the cover 32 permits access to the first section 112 of the circuit board 34 and prevents access to the second section 114 of the circuit board 34, and vice versa. Concurrent access to both the first section 112 and 114 (and particularly the jumper contacts associated therewith) is prevented. Thus, the cover 32 makes the selection of connecting the first and second electrical loads 126 and 128 intuitive and simplified. The positioning of the cover 32 will make it apparent whether jumpers 56 are to be engaged to the parallel circuit jumper contacts 58, or the series circuit jumper contacts 60. Further, the connection may be rapidly modified by the mere removal and insertion of the jumpers 56.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

What is claimed is:

1. A terminal assembly for coupling a plurality of electrical loads to a source comprising:

a circuit board defining a first section and a second section;

a first set of jumper contacts disposed on the first section of the circuit board and a second set of jumper contacts disposed on the second section of the circuit board;

a housing enclosing the circuit board;

a jumper access aperture defined by the housing and overlapping the first and second sections of the circuit board; and at least one cover positioned on the jumper access aperture of the housing to selectively expose the first section of the circuit board and the second section of the circuit board.

2. The terminal assembly of claim 1, wherein the cover is slidably engaged to the housing on the jumper access aperture, the cover being in a first position to expose the first section of the circuit board including the first set of jumper contacts and a second position to expose the second section of the circuit board including the second set of jumper contacts.

3. The terminal assembly of claim 1, wherein the first set of jumper contacts is configured to receive at least two jumpers which in combination are adapted to couple the electrical loads in parallel.

4. The terminal assembly of claim 1, wherein the second set of jumper contacts is configured to receive at least one jumper which is adapted to couple the electrical loads in series.

5. The terminal assembly of claim 1, wherein each of the first set of jumper contacts and the second set of jumper contacts include clamps configured to slidably retain jumpers.

6. The terminal assembly of claim 1, further comprising a quick release mechanism mated to the first set of jumper contacts and configured to releasably engage a jumper to the first set of jumper contacts.

* * * * *